US008944214B2

(12) United States Patent
Worthington

(10) Patent No.: US 8,944,214 B2
(45) Date of Patent: Feb. 3, 2015

(54) AUTOMATIC LOCKING SYSTEM FOR A SELF-ADJUSTABLE LEVELING LADDER

(71) Applicant: Gary Landon Worthington, Moorpark, CA (US)

(72) Inventor: Gary Landon Worthington, Moorpark, CA (US)

( * ) Notice: Subject to any disclaimer, the term of this patent is extended or adjusted under 35 U.S.C. 154(b) by 81 days.

(21) Appl. No.: 13/888,362

(22) Filed: May 6, 2013

(65) Prior Publication Data

US 2013/0292525 A1 Nov. 7, 2013

Related U.S. Application Data

(60) Provisional application No. 61/642,933, filed on May 4, 2012.

(51) Int. Cl.
*E06C 7/44* (2006.01)

(52) U.S. Cl.
CPC ..... *E06C 7/44* (2013.01)
USPC ..... 182/200

(58) Field of Classification Search
CPC ..... E06C 7/44
USPC ..... 182/200
See application file for complete search history.

(56) References Cited

U.S. PATENT DOCUMENTS

| | | | | |
|---|---|---|---|---|
| 2,555,036 | A * | 5/1951 | Husted | 182/202 |
| 2,633,283 | A * | 3/1953 | Derby | 182/200 |
| 2,960,182 | A * | 11/1960 | Swanson | 182/200 |
| 3,086,612 | A * | 4/1963 | McKinley | 182/200 |
| 6,336,521 | B1 | 1/2002 | Dennis | |
| 8,360,204 | B2 * | 1/2013 | Worthington | 182/200 |

* cited by examiner

*Primary Examiner* — Alvin Chin-Shue

(57) ABSTRACT

An automatic locking system for a self-adjustable leveling ladder engages when the ladder is placed on the ground and disengages when the ladder is lifted off the ground. The automatic locking system includes a clamping mechanism, a first support, and a second support. The clamping mechanism includes a first member, a second member, a central pivot, a pair of key plates, and a cross rail. The first support pivotally connects to the first member, and the second support pivotally connects to the second member. The first member hingedly connects to the second member by the central pivot, which allows the key plates to grasp the cross rail if the first support and the second support are pressed against the ground. The first member and the second member are able to slide along the cross rail, which properly adjusts the first support and the second support for an uneven ground surface.

13 Claims, 10 Drawing Sheets

AUTOMATIC LOCKING SYSTEM FOR A SELF-ADJUSTABLE LEVELING LADDER

The current application claims a priority to the U.S. Provisional Patent application Ser. No. 61/642,933 filed on May 4, 2012. The current application is filed on May 6, 2013 while May 4, 2013 was on a weekend.

FIELD OF THE INVENTION

The present invention relates generally to an apparatus for a ladder. More specifically, the present invention relates to a locking mechanism for a ladder that has self-adjusting legs for the purpose of supporting a ladder in a level manner on an uneven surface.

BACKGROUND OF THE INVENTION

One of the most common pieces of equipment for both household and work use is the ladder. There exist many different ladders and ladder accessories which offer certain types of adjustability to increase the usability and to address diverse situations. There also exist many different types of locking mechanisms which are used to keep a ladder in the adjusted position, whatever they may be. Most locking mechanisms are designed to be manually activated and manually deactivated. A locking mechanism capable of self-locking at a locking point is typically spring loaded and is manually prepared to lock at a point. U.S. Pat. No. 6,336,521 discloses a ladder leveling device which is easy to operate. However, this ladder leveling device also requires that the user unlock bracket assemblies in order to allow the stabilizing arcuate member to be properly positioned so as to level the ladder, and then subsequently manually lock the locking brackets in place.

Accordingly, there is a continuing need for ladders which can be stabilized in a level manner on uneven surfaces. There is also a continuing need for a locking mechanism that is automatic and self-engaging and disengaging in nature so as not to require manual manipulation. The present invention fulfills these needs, and provides other advantages. It is therefore an object of the present invention to provide an apparatus for a self-engaging and self-disengaging lock for use in conjunction with a ladder leveling device.

DETAIL DESCRIPTIONS OF THE INVENTION

All illustrations of the drawings are for the purpose of describing selected versions of the present invention and are not intended to limit the scope of the present invention.

Figure 8:
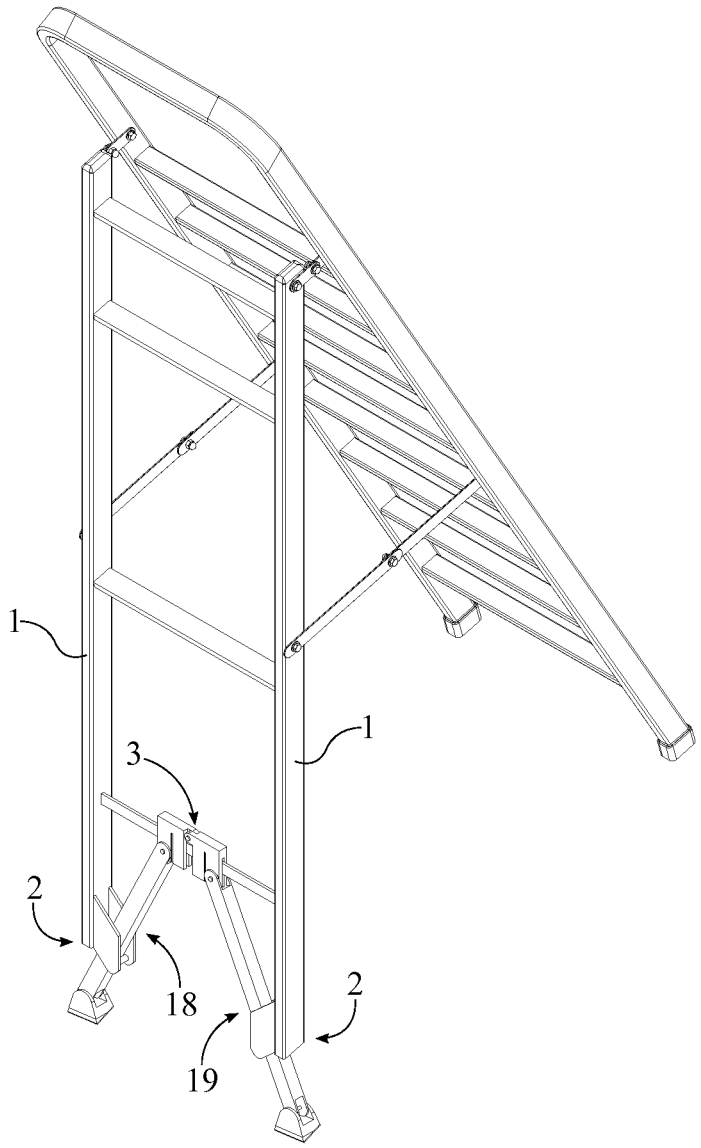
FIG. 8 shows the present invention attached to a ladder in the unlocked position, wherein the first structural member and the second structural member are positioned at the center of the cross rail.
Figure 9:
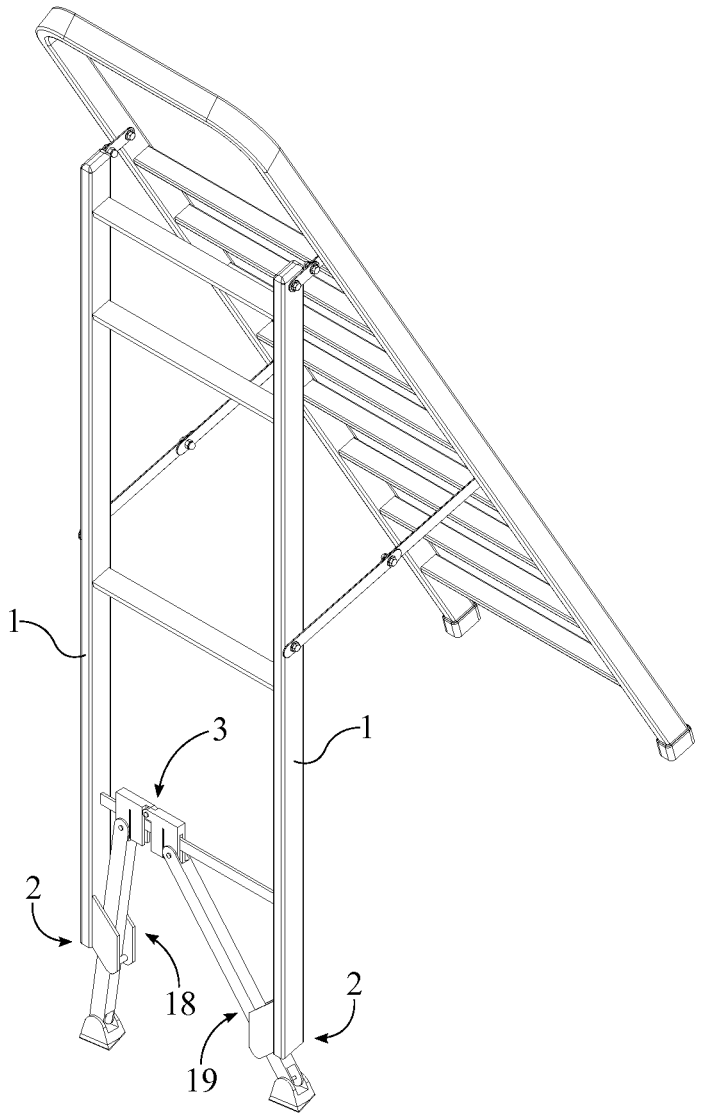
FIG. 9 shows the present invention attached to a ladder in the unlocked position, wherein the first structural member and the second structural member have slid away from the center of the cross rail.
Figure 10:
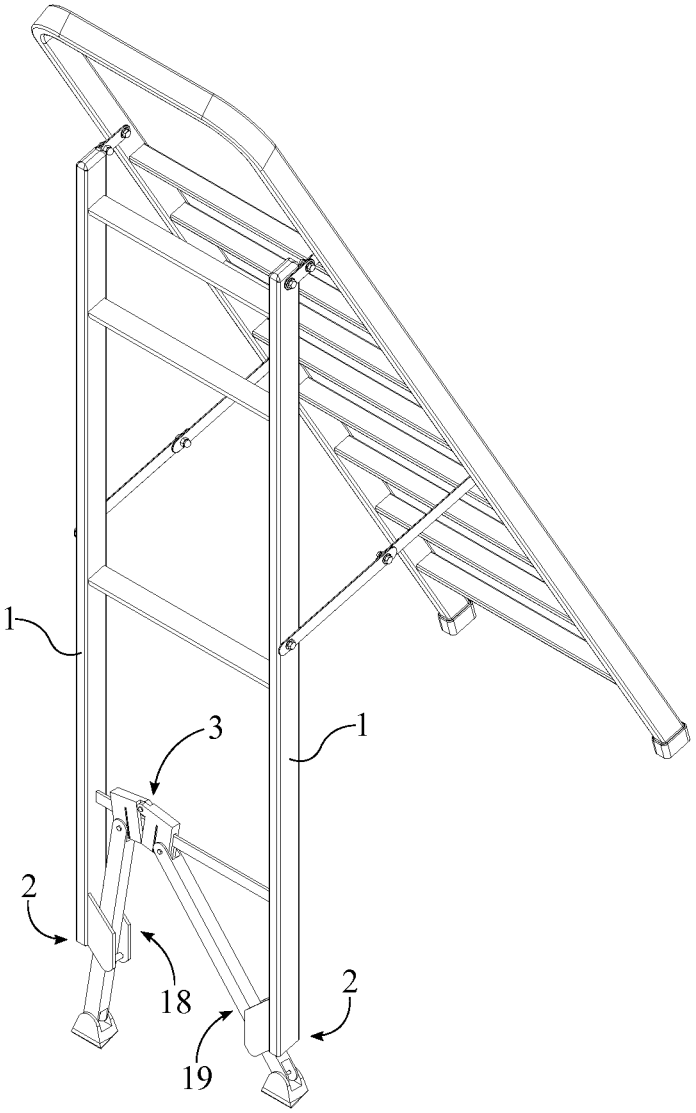
FIG. 10 shows the present invention attached to a ladder in the unlocked position, wherein the first structural member and the second structural member have slid away from the center of the cross rail.

As can be seen in FIGS. 8, 9, and 10, the present invention is an automatic locking system for a self-adjustable leveling ladder, which locks when the self-adjustable leveling ladder is placed on the ground and unlocks when the self-adjustable leveling ladder is lifted off the ground. The present invention mainly comprises a clamping mechanism 3, a first support 18, and a second support 19. A pair of opposing ladder rails 1 is the structural portion of a ladder that the components of the present invention are integrated onto. The pair of opposing ladder rails 1 could be a part of a number of different kinds of ladders such as a folding ladder or an extension ladder. The first support 18 and the second support 19 are configured to adjust and level if the pair of opposing ladder rails 1 is placed on an uneven surface. For example, if the pair of opposing ladder rails 1 is placed on a sidewalk curb, then either the first support 18 or the second support 19 would extend to the lower echelon of the sidewalk curb so that the pair of opposing ladder rails 1 remains leveled on the sidewalk curb. The clamping mechanism 3 is used to automatically hold the first support 18 and the second support 19 in place once the pair of opposing ladder rails 1 is pressed against the ground. The clamping mechanism 3 is also used to automatically release the first support 18 and the second support 19 once the pair of opposing ladder rails 1 is lifted off the ground. The present invention can also be used on other apparatuses that have at least one pair of supporting legs or rails such as a table or a chair.

Figure 1:
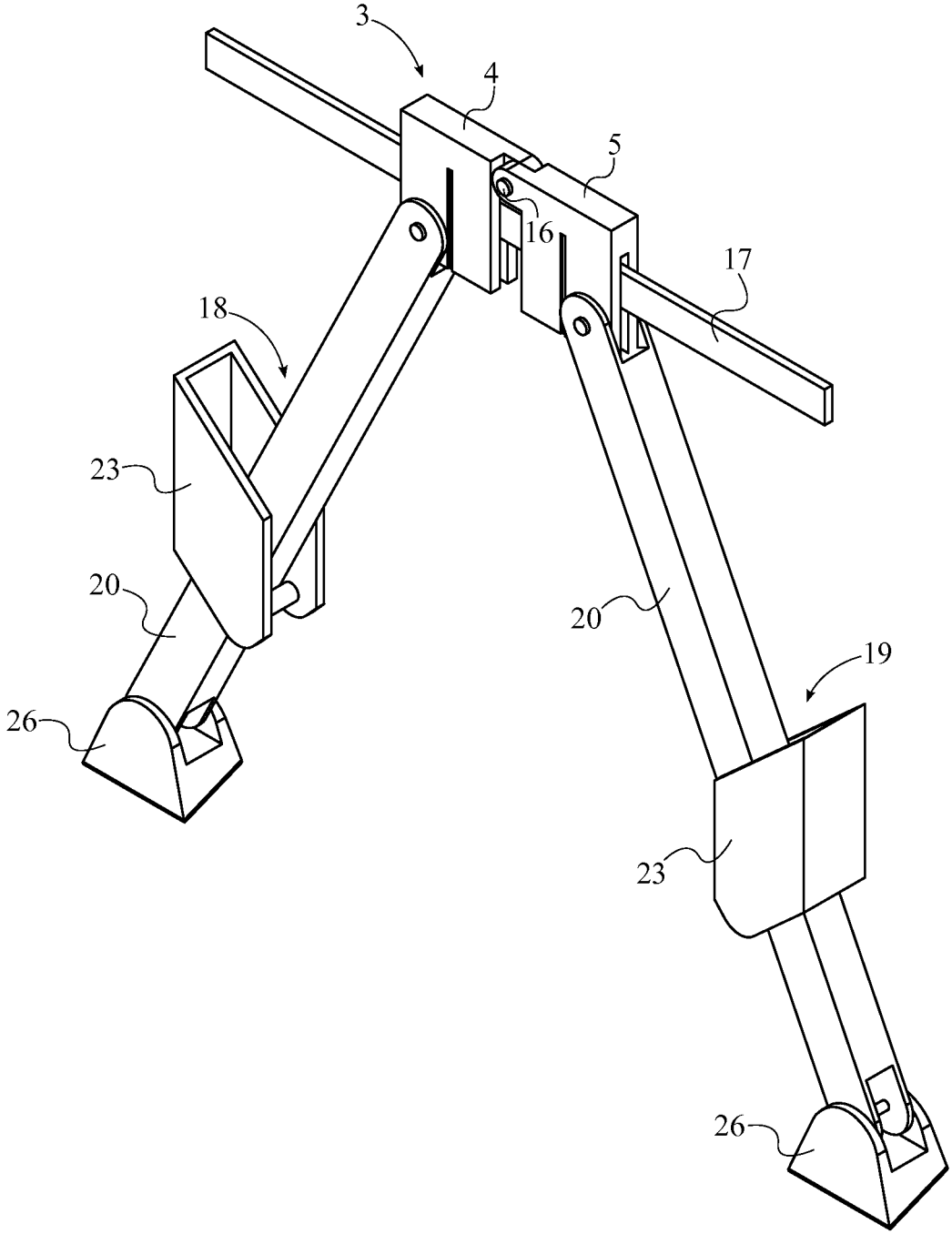
FIG. 1 is a perspective view of the present invention in the unlocked position, wherein the first structural member and the second structural member are positioned at the center of the cross rail.
Figure 2:
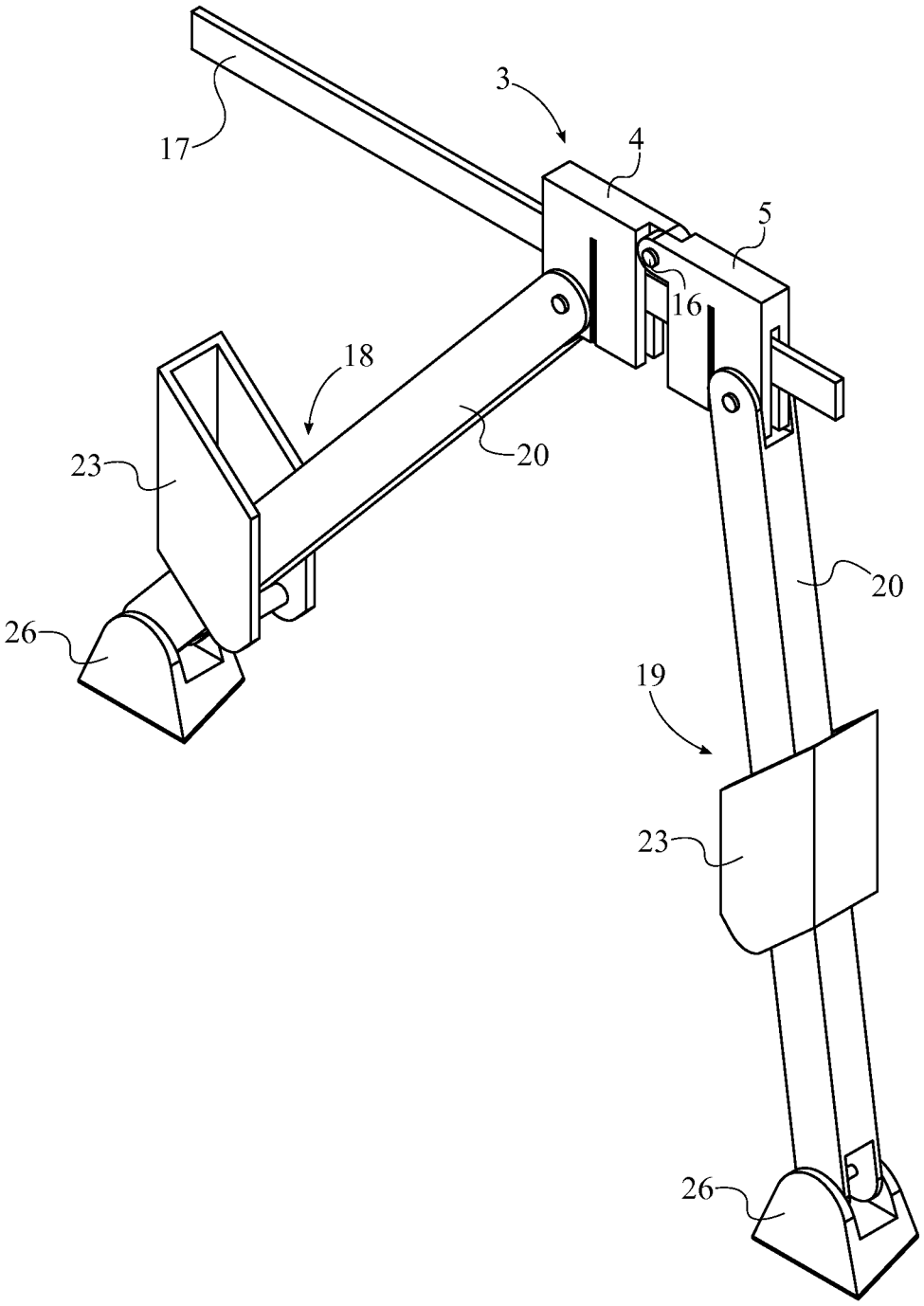
FIG. 2 is a perspective view of the present invention in the unlocked portion, wherein the first structural member and the second structural member have slid away from the center of the cross rail.
Figure 4:
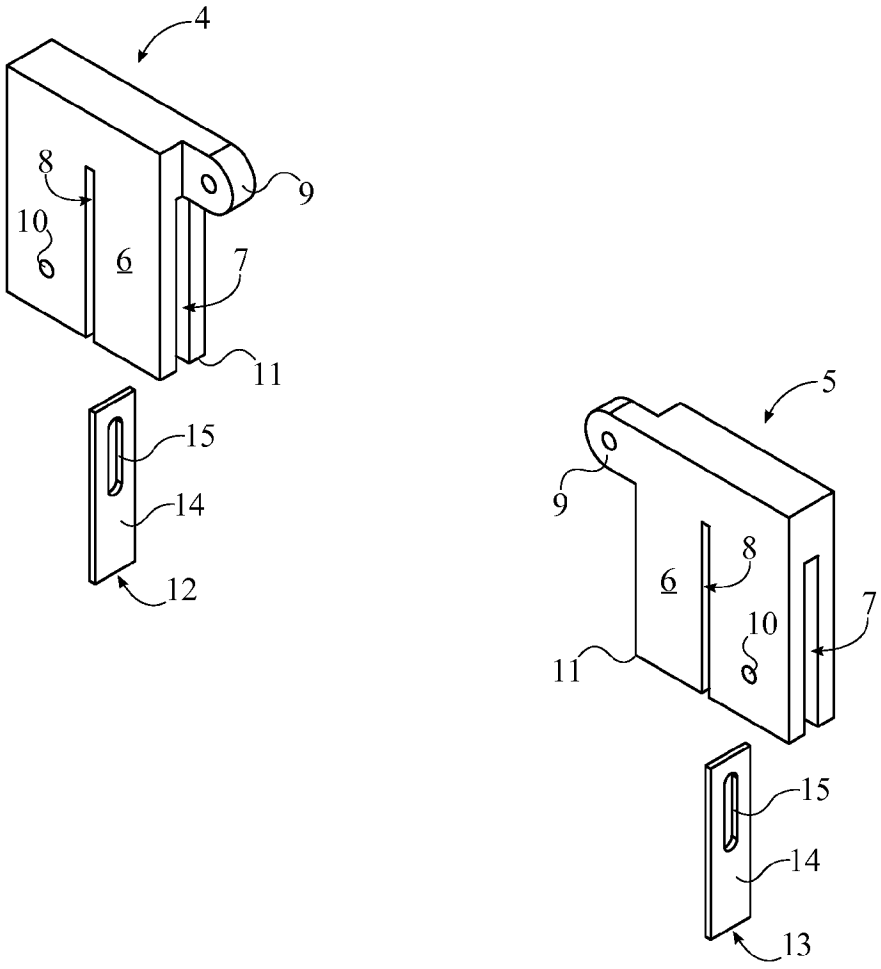
FIG. 4 is a perspective view of the first structural member, the second structural member, the first key-plate, and the second key-plate.
Figure 5:
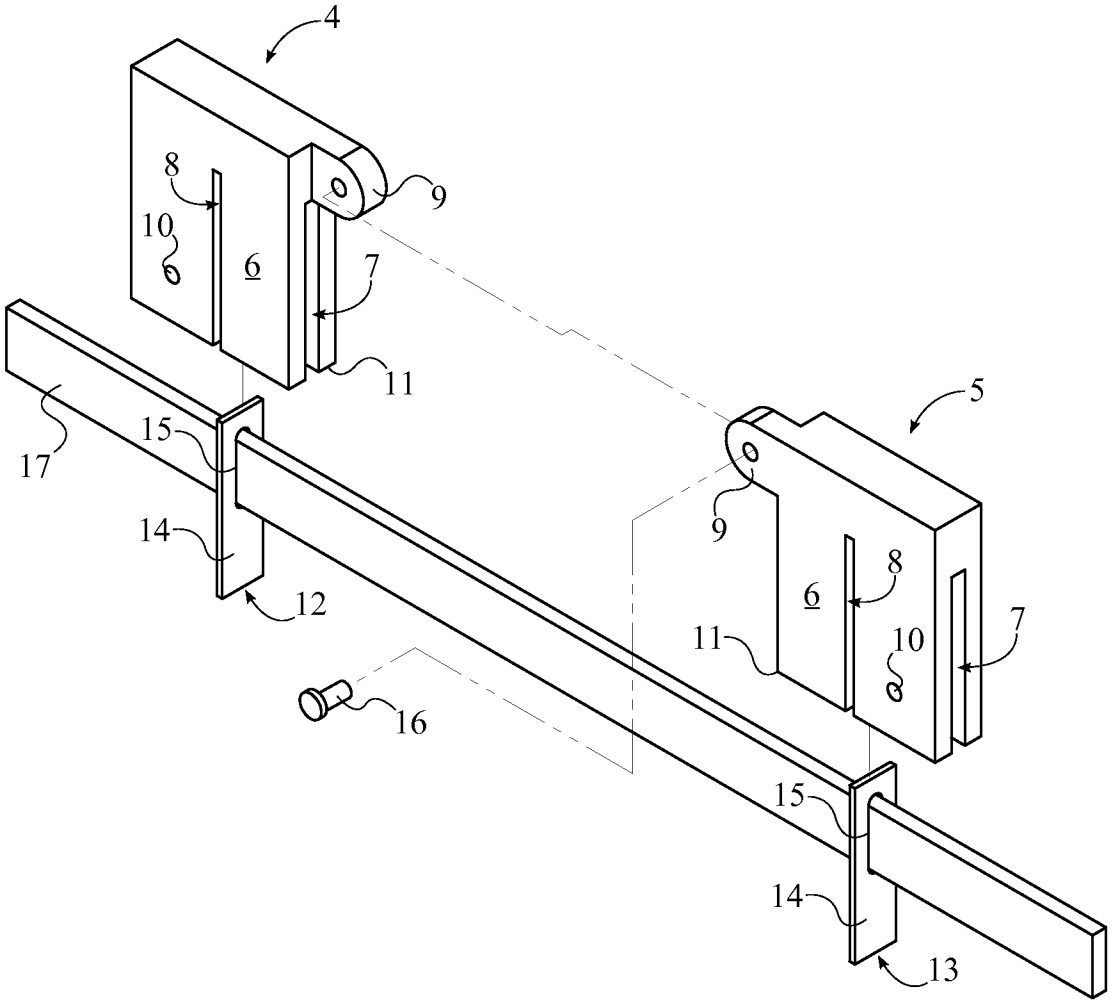
FIG. 5 is an exploded view of the clamping mechanism in the unlocked position.
Figure 6:
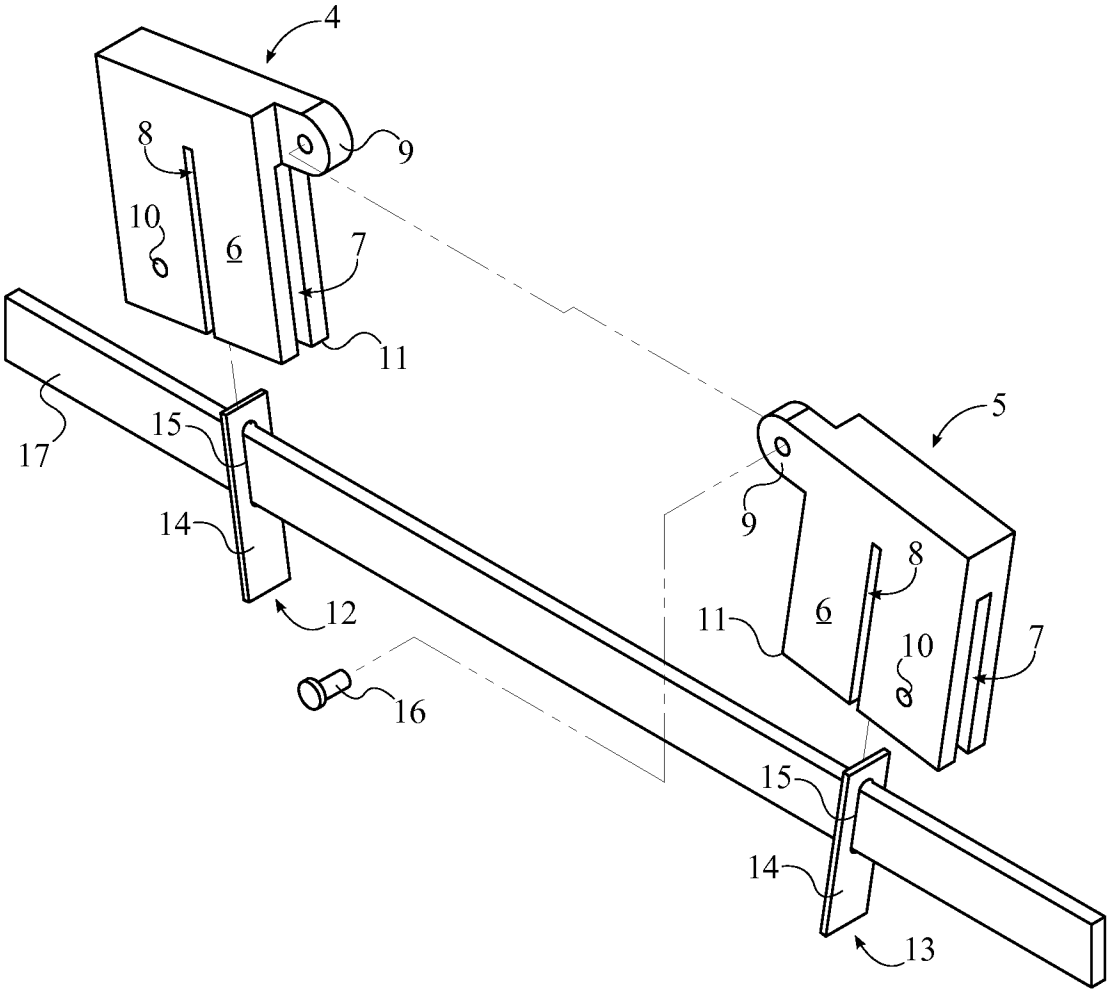
FIG. 6 is an exploded view of the clamping mechanism in the locked position.

As can be seen in FIGS. 1 and 2, the clamping mechanism 3 is able to translate between the pair of opposing ladder rails 1 and allows the present invention to lock the first support 18 and the second support 19 anywhere in between the pair of opposing ladder rails 1. The clamping mechanism 3 comprises a first structural member 4, a second structural member 5, a first key-plate 12, a second key-plate 13, a central pivot 16, and a cross rail 17, which are shown in FIGS. 4, 5, and 6. The first structural member 4 and the second structural member 5 are corresponding mechanical components that are used lock and unlock the clamping mechanism 3. The central pivot 16 is used to hingedly connect the first structural member 4 with the second structural member 5, which allows the first structural member 4 and the second structural member 5 to clamp and unclamp the cross rail 17. In the preferred embodiment of the present invention, the central pivot 16 can be a pin or a rivet. The cross rail 17 is connected in between the pair of opposing ladder rails 1 so that the first structural member 4 and the second structural member 5 can slide between the pair of opposing ladder rails 1. The first structural member 4 and the second structural member 5 are able to fold closer together by the central pivot 16, which allows the first key-plate 12 and the second key-plate 13 to grasp the cross rail 17. The first key-plate 12 applies a locking pressure on the cross rail 17 in one direction, and the second key-plate 13 applies another locking pressure on the cross rail 17 in the opposite direction, which further stabilizes the first structural member 4 and the second structural member 5 in the locked position.

As can be seen in FIG. 4, the first structural member 4 and the second structural member 5 have a simplistic, efficient design in order to prevent mechanical complications while using the clamping mechanism 3. The first structural member 4 and the second structural member 5 each comprise a main body 6, a longitudinal channel 7, a transversal channel 8, a rounded tab 9, a lateral pivot 10, and a stop point 11. The main body 6 is used to position and configure the other components of the structural member. The longitudinal channel 7 allows the main body 6 to slide along the cross rail 17. The longitudinal channel 7 traverses into the main body 6 from the bottom so that the main body 6 can be situate upon the cross rail 17. The longitudinal channel 7 also laterally traverses through the main body 6, which allows the main body 6 to slide from side to side on the cross rail 17. The longitudinal channel 7 is perpendicularly intersected by the transversal channel 8, which is used to house a key-plate within the main body 6. Similar to the longitudinal channel 7, the transversal channel 8 traverses into the main body 6 from the bottom and laterally traverses through the main body 6 so that a key-plate is able to freely float while being housed by the transversal channel 8. The rounded tab 9 is used to extend the main body 6 away from the central pivot 16 so that the main body 6 for both the first structural member 4 and the second structural member 5 do not interfere with each other while rotating about the central pivot 16. Thus, the rounded tab 9 is connected to the main body 6. The lateral pivot 10 allows its corresponding support to rotate with respect to the main body 6 and is diagonally opposed to the rounded tab 9 across the main body 6. When the clamping mechanism 3 is in the locked position, the stop point 11 of the first structural member 4 will press against the stop point 11 of the second structural member 5 so that the first structural member 4 and the second structural member 5 will stop rotating about the central pivot 16. Consequently, the stop point 11 is adjacently opposed to the round tab across the main body 6.

Figure 3:
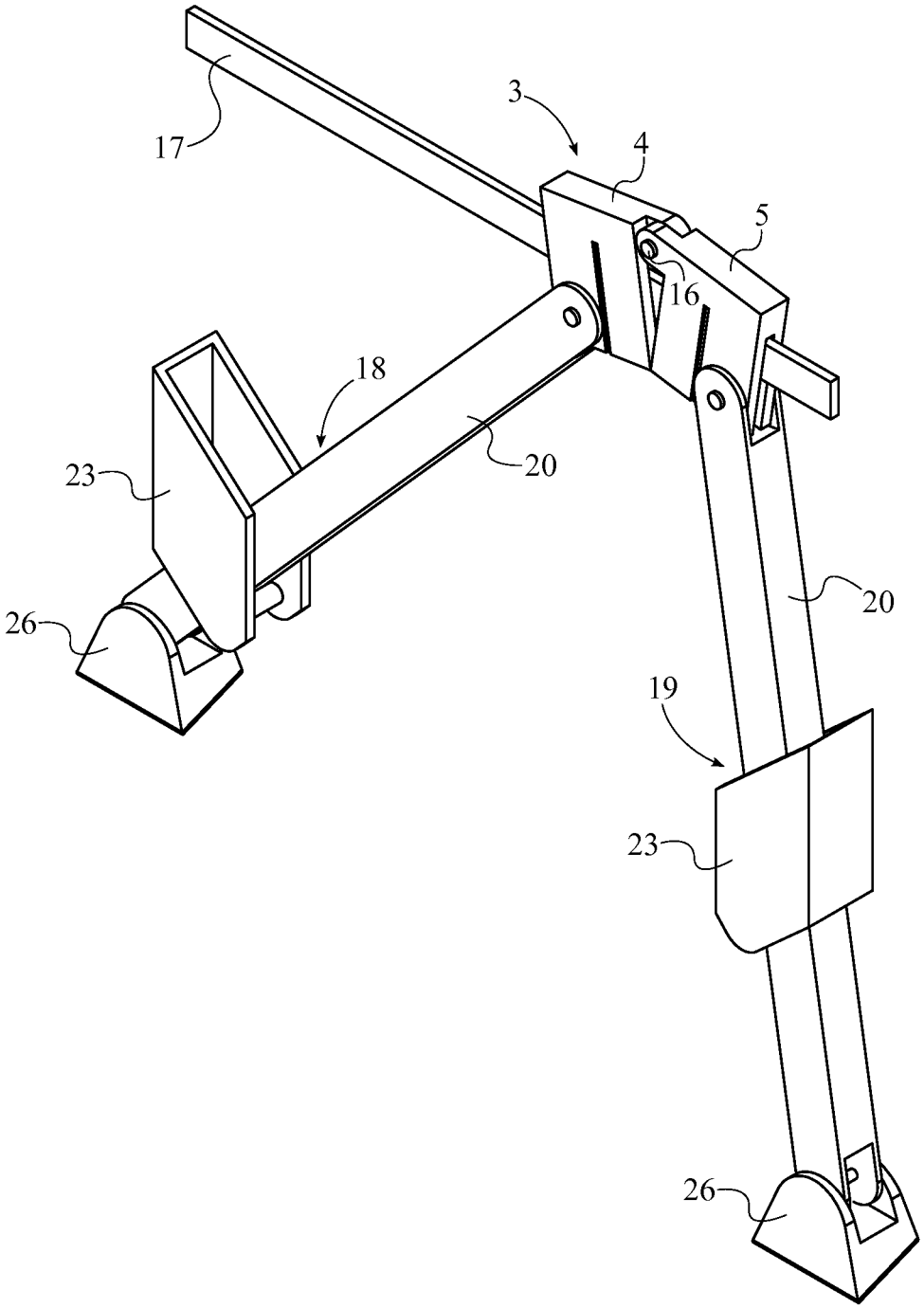
FIG. 3 is a perspective view of the present invention in the locked portion, wherein the first structural member and the second structural member have slid away from the center of the cross rail.

The first key-plate 12 and the second key-plate 13 are used to automatically grasp the cross rail 17 once the first support 18 and the second support 19 are placed on the ground, which is illustrated in FIG. 3. The first key-plate 12 and the second key-plate 13 each comprise a flat body 14 and a slot 15 and are shown in FIG. 4. The slot 15 is positioned through the flat body 14 so that the cross rail 17 can traverse through the slot 15 for both the first key-plate 12 and the second key-plate 13. Thus, the first key-plate 12 and the second key-plate 13 can freely slide along the cross rail 17 and can lock the clamping mechanism 3 at any linear position in between the pair of opposing ladder rails 1. In the preferred embodiment of the present invention, the slot 15 should be sized to match the cross-sectional area of the cross rail 17. If the first key-plate 12 and the second key-plate 13 are slidably engaged to the cross rail 17, then the first key-plate 12 can be floatably positioned within the transversal channel 8 of the first structural member 4, and the second key-plate 13 can be floatably positioned within the transversal channel 8 of the second structural member 5. Consequently, the first structural member 4 can guide the movement of the first key-plate 12, and the second structural member 5 can guide the movement of the second key-plate 13. When the clamping mechanism 3 is in the unlocked position as depicted in FIG. 2, the first key-plate 12 is held perpendicular to the cross rail 17 by the first structural member 4, and the second key-plate 13 is held perpendicular to the cross rail 17 by the second structural member 5, which is shown in FIG. 5. When the clamping mechanism 3 is in the locked position as depicted in FIG. 3, the first key-plate 12 is slanted in one direction by the first structural member 4 in order to grasp the cross rail 17, and the second key-plate 13 is slanted in the opposite direction by the second structural member 5 to order to grasp the cross rail 17, which is shown in FIG. 6.

In addition, if the first key-plate 12 and the second key-plate 13 are slidably engaged to the cross rail 17, then the first structural member 4 and the second structural member 5 can be situate upon and can slidably engaged to the cross rail 17. In this configuration, the central pivot 16 is located adjacent and above the cross rail 17. The rounded tab 9 for both the first structural member 4 and the second structural member 5 is positioned in between the main body 6 of the first structural member 4 and the main body 6 of the second structural member 5, which allows the rounded tab 9 of the first structural member 4 to be hingedly connected to the rounded tab 9 of the second structural member 5. Also in this configuration, the lateral pivot 10 for both the first structural member 4 and the second structural member 5 is located adjacent and below the cross rail 17 opposite to the central pivot 16. This configuration utilizes the cross rail 17 as a fulcrum so that the main body 6 can leverage the central pivot 16 upwards when its respective support is placed on the ground and pushes upward on the lateral pivot 10.

Figure 7:
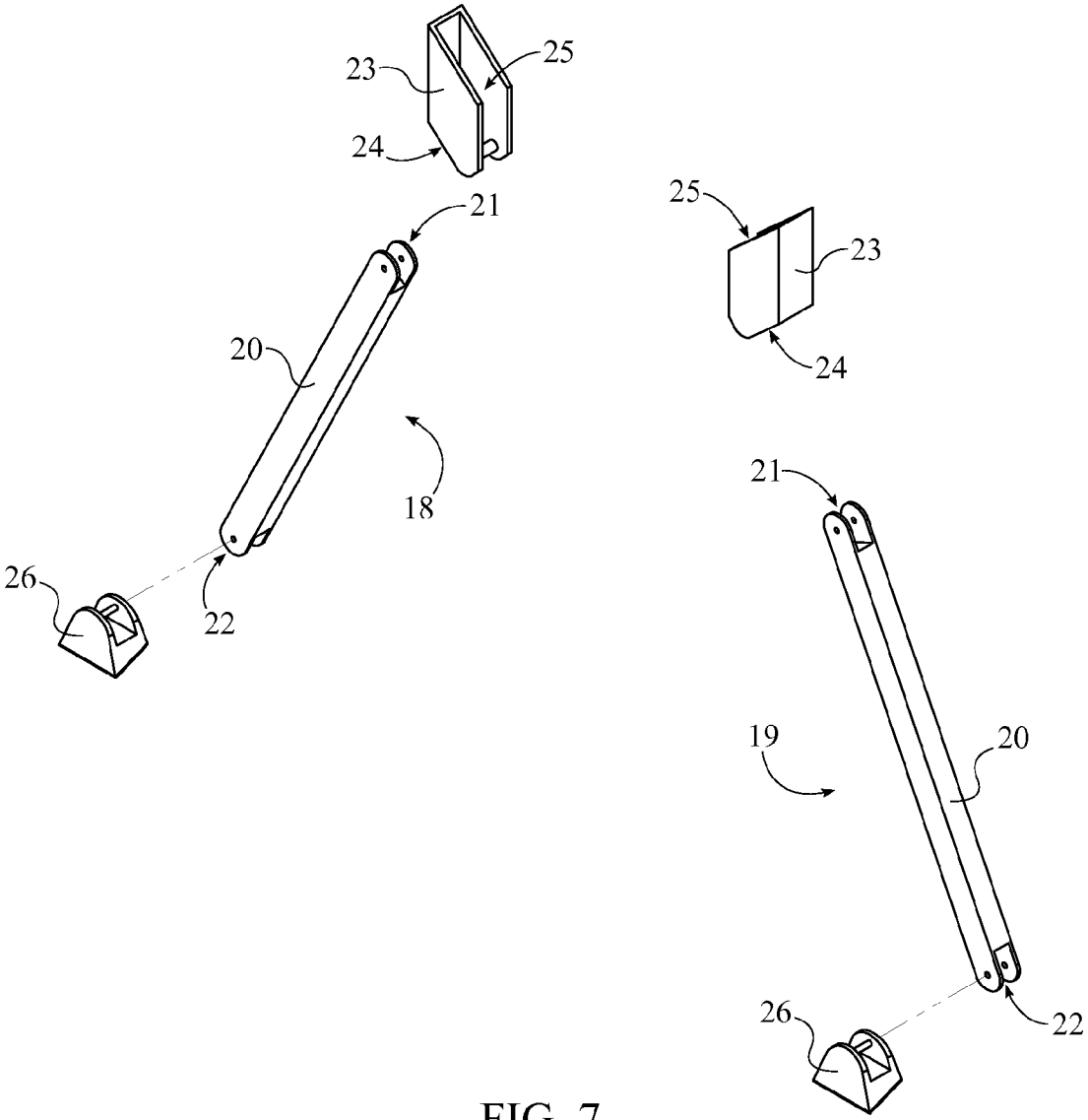
FIG. 7 is an exploded view of the first support and the second support.

The first support 18 and the second support 19 extend downwardly towards the ground from the clamping mechanism 3 and the cross rail 17. The first support 18 and the second support 19 are designed with joints to conform to an uneven surface and to properly support the pair of opposing ladder rails 1 on the uneven surface. The first support 18 and the second support 19 each comprise a leg 20, a hollowed guide 23, and a foot 26, which are illustrated in FIG. 7. The leg 20 is the primary structural component that is used to brace the weight of a ladder against the ground. The leg 20 comprises a proximal end 21 and a distal end 22, which positioned opposite of each other along the leg 20. The proximal end 21 of the first support 18 is hingedly connected to the lateral pivot 10 of the first structural member 4, which allows the first support 18 to rotate with respect to the first structural member 4 as the first structural member 4 slides along the cross rail 17. Likewise, the proximal end 21 of the second support 19 is hingedly connected to the lateral pivot 10 of the second structural member 5, which allows the second support 19 to rotate with respect to the second structural member 5 as the second structural member 5 slides along the cross rail 17. For both the first support 18 and the second support 19, the distal end 22 is hingedly connected to the foot 26 so that each support can properly brace the ground for different orientations of the leg 20. Thus, the foot 26 can always be positioned to be parallel to the ground.

As can be seen in FIGS. 8, 9, and 10, the hollowed guide 23 is a means of stabilizing the distal end 22 of the leg 20 while the proximal end 21 is stabilized by the lateral pivot 10. Thus, the leg 20 traverses through the hollowed guide 23. The hollowed guide 23 comprises a narrow-range end 24 and a wide-range end 25. The narrow-range end 24 allows limited angular movement for the leg 20 about the distal end 22, and the wide-range end 25 allows larger angular movement for the leg 20 about the proximal end 21. In order to explain the positioning for each hollowed guide 23, the pair of opposing ladder rails 1 should be described as a first rail and a second rail. The hollowed guide 23 of the first support 18 is connected along the first rail in such a way that the narrow-range end 24 of the first support 18 is positioned adjacent to the bottom end 2 of the first rail. Consequently, the wide-range end 25 of the first support 18 is positioned opposite to the bottom end 2 of the second rail. The narrow-range end 24 and the wide-range end 25 of the first support 18 allows the hollowed guide 23 to control the angular movement of the first support 18 as the first structural member 4 slides along the cross rail 17. Similarly, the hollowed guide 23 of the second support 19 is connected along the second rail in such a way that the narrow-range end 24 of the second support 19 is positioned adjacent to the bottom end 2 of the second rail. Consequently, the wide-range end 25 of the second support 19 is positioned opposite to the bottom end 2 of the second rail. The narrow-range end 24 and the wide-range end 25 of the second support 19 allows the hollowed guide 23 to control the angular movement of the second support 19 as the second structural member 5 slides along the cross rail 17.

The present invention is configured to address the situation when a ladder is placed on uneven ground. When the first support 18 comes in contact with the ground, the first support 18 forces the first structural member 4 and the second structural member 5 to slide along the cross rail 17 until the second support 19 comes in contact with the ground. Consequently, an opposite upward force is created by the first support 18, which causes the first structural member 4 and the second structural member 5 to pivot and lock the first key-plate 12 and the second key-plate 13 down onto the cross rail 17 in order to prevent any movement by the clamping mechanism 3. When the ladder is picked up from the ground, and the upward force of the first support 18 and the second support 19 is released. Consequently, gravity causes the first structural member 4 and the second structural member 5 to rock back into the unlocked position, where the first structural member 4 and the second structural member 5 are free to slide from side to side along the cross rail 17.

Although the invention has been explained in relation to its preferred embodiment, it is to be understood that many other possible modifications and variations can be made without departing from the spirit and scope of the invention as hereinafter claimed.

What is claimed is:

1. An automatic locking system for a self-adjustable leveling ladder comprises:

a clamping mechanism;

a first support;

a second support;

said clamping mechanism comprises a first structural member, a second structural member, a first key-plate, a second key-plate, a central pivot, and a cross rail;

said first support and said second support each comprise a leg, a hollowed guide, and a foot;

said first structural member and said second structural member each comprises a main body, a longitudinal channel, a transversal channel, a rounded tab, a lateral pivot, and a stop point;

said first key-plate and said second key-plate each comprise a flat body and a slot;

said leg comprises a proximal end and a distal end; and said guide comprises a narrow-range end and a wide-range end.

2. The automatic locking system for a self-adjustable leveling ladder as claimed in claim 1 comprises:

said longitudinal channel traversing into said main body;

said transversal channel laterally traversing through said main body; and said longitudinal channel being perpendicularly intersected by said transversal channel.

3. The automatic locking system for a self-adjustable leveling ladder as claimed in claim 1 comprises:

said rounded tab being connected to said respective main body;

respective said lateral pivot being diagonally opposed to respective said rounded tab across respective said main body; and respective said stop point being adjacently opposed to respective said rounded tab across respective said main body.

4. The automatic locking system for a self-adjustable leveling ladder as claimed in claim 1 comprises:

said slot being positioned through respective said flat body; and said cross rail traversing through said slot for both said first key-plate and said second key-plate.

5. The automatic locking system for a self-adjustable leveling ladder as claimed in claim 1 comprises:

said longitudinal channel for both said first structural member and said second structural member being slidably engaged to said cross rail;

said first key-plate being floatably positioned within said transversal channel of said first structural member;

said second key-plate being floatably positioned within said transversal channel of said second structural member;

said rounded tab of said first structural member being hingedly connected said rounded tab of said second structural member by said central pivot;

said central pivot being located adjacent to said cross rail; and said lateral pivot for both said first structural member and said second structural member being located adjacent to said cross rail opposite of said central pivot.

6. The automatic locking system for a self-adjustable leveling ladder as claimed in claim 1 comprises:

said proximal end and said distal end being positioned opposite to each other along respective said leg;

said distal end being hingedly connected to respective said foot;

said proximal end of said first support being hingedly connected to said lateral pivot of said first structural member; and said proximal end of said second support being hingedly connected to said lateral pivot of said second structural member.

7. The automatic locking system for a self-adjustable leveling ladder as claimed in claim 1 comprises:

said cross rail being connected in between a pair of opposing ladder rails;

each of said pair of opposing ladder rails comprises a bottom end;

said pair of opposing ladder rails consists of a first rail and a second rail;

said narrow-range end and said wide-range end being positioned opposite to each other along said hollowed guide;

each said leg traversing through respective said hollowed guide;

said hollowed guide of said first support being connected along said first rail;

said narrow-range end of said first support being positioned adjacent to said bottom end of said first rail;

said wide-range end of said first support being positioned opposite from said bottom end of said first rail;

said hollowed guide of said second support being connected along said second rail;

said narrow-range end of said second support being positioned adjacent to said bottom end of said second rail; and said wide-range end of said second support being positioned opposite from said bottom end of said second rail.

8. An automatic locking system for a self-adjustable leveling ladder comprises:

a clamping mechanism;

a first support;

a second support;

said clamping mechanism comprises a first structural member, a second structural member, a first key-plate, a second key-plate, a central pivot, and a cross rail;

said first support and said second support each comprise a leg, a hollowed guide, and a foot;

said first structural member and said second structural member each comprises a main body, a longitudinal channel, a transversal channel, a rounded tab, a lateral pivot, and a stop point;

said first key-plate and said second key-plate each comprise a flat body and a slot;

said leg comprises a proximal end and a distal end;

said guide comprises a narrow-range end and a wide-range end;

said longitudinal channel for both said first structural member and said second structural member being slidably engaged to said cross rail;

said first key-plate being floatably positioned within said transversal channel of said first structural member;

said second key-plate being floatably positioned within said transversal channel of said second structural member;

said rounded tab of said first structural member being hingedly connected said rounded tab of said second structural member by said central pivot;

said central pivot being located adjacent to said cross rail; and said lateral pivot for both said first structural member and said second structural member being located adjacent to said cross rail opposite of said central pivot.

9. The automatic locking system for a self-adjustable leveling ladder as claimed in claim 8 comprises:

said longitudinal channel traversing into said main body;

said transversal channel laterally traversing through said main body;

said longitudinal channel being perpendicularly intersected by said transversal channel;

said rounded tab being connected to respective said main body;

respective said lateral pivot being diagonally opposed to respective said rounded tab across respective said main body;

respective said stop point being adjacently opposed to respective said rounded tab across respective said main body;

said slot being positioned through respective said flat body; and said cross rail traversing through said slot for both said first key-plate and said second key-plate.

10. The automatic locking system for a self-adjustable leveling ladder as claimed in claim 8 comprises:

said proximal end and said distal end being positioned opposite to each other along respective said leg;

said distal end being hingedly connected to respective said foot;

said proximal end of said first support being hingedly connected to said lateral pivot of said first structural member;

said proximal end of said second support being hingedly connected to said lateral pivot of said second structural member;

said cross rail being connected in between a pair of opposing ladder rails;

each of said pair of opposing ladder rails comprises a bottom end;

said pair of opposing ladder rails consists of a first rail and a second rail;

said narrow-range end and said wide-range end being positioned opposite to each other along said hollowed guide;

respective said leg traversing through respective said hollowed guide;

said hollowed guide of said first support being connected along said first rail;

said narrow-range end of said first support being positioned adjacent to said bottom end of said first rail;

said wide-range end of said first support being positioned opposite from said bottom end of said first rail;

said hollowed guide of said second support being connected along said second rail;

said narrow-range end of said second support being positioned adjacent to said bottom end of said second rail; and said wide-range end of said second support being positioned opposite from said bottom end of said second rail.

11. An automatic locking system for a self-adjustable leveling ladder comprises:

a clamping mechanism;

a first support;

a second support;

said clamping mechanism comprises a first structural member, a second structural member, a first key-plate, a second key-plate, a central pivot, and a cross rail;

said first support and said second support each comprise a leg, a hollowed guide, and a foot;

said first structural member and said second structural member each comprises a main body, a longitudinal channel, a transversal channel, a rounded tab, a lateral pivot, and a stop point;

said first key-plate and said second key-plate each comprise a flat body and a slot;

said leg comprises a proximal end and a distal end;

said guide comprises a narrow-range end and a wide-range end;

said longitudinal channel traversing into said main body;

said transversal channel laterally traversing through said main body;

said longitudinal channel being perpendicularly intersected by said transversal channel;

said rounded tab being connected to respective said main body;

respective said lateral pivot being diagonally opposed to respective said rounded tab across respective said main body;

respective said stop point being adjacently opposed to respective said rounded tab across respective said main body;

said slot being positioned through respective said flat body;

said cross rail traversing through said slot for both said first key-plate and said second key-plate;

said longitudinal channel for both said first structural member and said second structural member being slidably engaged to said cross rail;

said first key-plate being floatably positioned within said transversal channel of said first structural member;

said second key-plate being floatably positioned within said transversal channel of said second structural member;

said rounded tab of said first structural member being hingedly connected said rounded tab of said second structural member by said central pivot;

said central pivot being located adjacent to said cross rail; and said lateral pivot for both said first structural member and said second structural member being located adjacent to said cross rail opposite of said central pivot.

12. The automatic locking system for a self-adjustable leveling ladder as claimed in claim 11 comprises:

said proximal end and said distal end being positioned opposite to each other along respective said leg;

said distal end being hingedly connected to respective said foot;

said proximal end of said first support being hingedly connected to said lateral pivot of said first structural member; and said proximal end of said second support being hingedly connected to said lateral pivot of said second structural member.

13. The automatic locking system for a self-adjustable leveling ladder as claimed in claim 11 comprises:

said cross rail being connected in between a pair of opposing ladder rails;

each of said pair of opposing ladder rails comprises a bottom end;

said pair of opposing ladder rails consists of a first rail and a second rail;

said narrow-range end and said wide-range end being positioned opposite to each other along said hollowed guide;

each said leg traversing through respective said hollowed guide;

said hollowed guide of said first support being connected along said first rail;

said narrow-range end of said first support being positioned adjacent to said bottom end of said first rail;

said wide-range end of said first support being positioned opposite from said bottom end of said first rail;

said hollowed guide of said second support being connected along said second rail;

said narrow-range end of said second support being positioned adjacent to said bottom end of said second rail; and said wide-range end of said second support being positioned opposite from said bottom end of said second rail.

* * * * *